US010920663B1

(12) United States Patent
Daniel

(10) Patent No.: US 10,920,663 B1
(45) Date of Patent: Feb. 16, 2021

(54) INTERNAL COMBUSTION ENGINE WITH ROTATING PISTONS AND CYLINDERS AND RELATED DEVICES AND METHODS OF USING THE SAME

(71) Applicant: Dorce Daniel, Springville, CA (US)

(72) Inventor: Dorce Daniel, Springville, CA (US)

( * ) Notice: Subject to any disclaimer, the term of this patent is extended or adjusted under 35 U.S.C. 154(b) by 0 days.

(21) Appl. No.: 16/799,850

(22) Filed: Feb. 25, 2020

Related U.S. Application Data

(63) Continuation of application No. 16/733,208, filed on Jan. 2, 2020.

(60) Provisional application No. 62/938,958, filed on Nov. 22, 2019.

(51) Int. Cl.

| | |
|---|---|
| ***F02B 59/00*** | (2006.01) |
| ***F02B 57/02*** | (2006.01) |
| ***F02B 75/32*** | (2006.01) |
| ***F01N 13/10*** | (2010.01) |
| ***F02B 57/04*** | (2006.01) |

(52) U.S. Cl.
CPC ..... *F02B 59/00* (2013.01); *F01N 13/10* (2013.01); *F02B 57/02* (2013.01); *F02B 57/04* (2013.01); *F02B 75/32* (2013.01)

(58) Field of Classification Search
CPC ..... F02B 59/00; F02B 57/00–06
See application file for complete search history.

(56) References Cited

U.S. PATENT DOCUMENTS

| | | | | |
|---|---|---|---|---|
| 131,025 A | | 9/1872 | Porter | |
| 933,316 A | * | 9/1909 | Macomber | F02B 75/26 123/43 A |
| 980,491 A | * | 1/1911 | Coleman | F02B 75/26 123/43 A |
| 1,673,632 A | * | 6/1928 | Mattson | F01B 3/0032 123/43 A |
| 3,517,651 A | | 6/1970 | Graybill | |
| 5,113,809 A | | 5/1992 | Ellenburg | |
| 6,244,159 B1 | | 6/2001 | Kimura et al. | |

(Continued)

FOREIGN PATENT DOCUMENTS

| | | |
|---|---|---|
| GB | 2540072 A | 1/2014 |
| KR | 20000011236 A | 2/2000 |
| WO | 2008108670 | 12/2008 |

OTHER PUBLICATIONS

Printout of http://www.dukeengines.com.

(Continued)

*Primary Examiner* — Hung Q Nguyen
*Assistant Examiner* — Mark L. Greene
(74) *Attorney, Agent, or Firm* — William K. Nelson; Sierra IP Law, PC

(57) ABSTRACT

The present invention provides a novel internal combustion engine design and methods for using the same. The internal combustion engine of the present invention may include two rotors on which the pistons and cylinders and pistons are mounted, respectively. A plurality of cylinders mounted on a cylinder rotor, and a plurality of pistons mounted on a piston rod rotor, where the arrangements of the pistons and cylinders are complementary and each piston is paired with one of the cylinders. The cylinder rotor and the piston rod rotor may be position at oblique angle relative to one another, such that their central axes are located on a same plane, but the axes are not coaxially aligned and intersect on that plane.

18 Claims, 7 Drawing Sheets

(56) References Cited

U.S. PATENT DOCUMENTS

| | | | | |
|---|---|---|---|---|
| 7,315,779 | B1 * | 1/2008 | Rioux | B62J 27/00 123/352 |
| 7,677,210 | B2 | 4/2010 | Chasin et al. | |
| 8,334,604 | B1 | 12/2012 | Dunn et al. | |
| 8,689,674 | B2 | 4/2014 | Duke et al. | |
| 9,103,333 | B2 | 8/2015 | Duke | |
| 9,896,933 | B1 | 2/2018 | Knezek et al. | |
| 10,533,544 | B2 | 1/2020 | Funasaka et al. | |
| 2006/0054117 | A1 | 4/2006 | Stephens | |
| 2010/0000492 | A1 * | 1/2010 | Ambardekar | F01C 1/077 123/245 |

OTHER PUBLICATIONS

Print out of https://www.youtube.com/watch?v=m7mh6IGQ58g—dated 2014.
Print out of https://www.youtube.com/watch?v=_VSOgJn-3wo—dated 2016.
Print out of https://www.youtube.com/watch?v=josJhz8VS8A—dated 2014.
Print out of https://en.wikipedia.org/wiki/Tucker_48.
English abstract of Korean Application No. KR20000011236, published on Feb. 25, 2000.

* cited by examiner

Exhast Arrangement

Intake System

INTERNAL COMBUSTION ENGINE WITH ROTATING PISTONS AND CYLINDERS AND RELATED DEVICES AND METHODS OF USING THE SAME

This is a US non-provisional utility patent application claiming priority to U.S. Provisional Patent Application No. 62/938,958, filed Nov. 22, 2019, which is incorporated herein by this reference in its entirety.

FIELD OF THE INVENTION

The present invention relates to a new internal combustion engine design and related apparatuses and methods of using the same. More particularly, the present invention relates to an internal combustion engine having rotating pistons and cylinders.

DISCUSSION OF THE BACKGROUND

Conventional internal combustion engines have pistons that move in and out (reciprocate) of cylinders in a stationary cylinder block. Combustion in the cylinders is timed to cause the pistons to be ejected from the cylinder and to turn a crank shaft, converting the chemical energy of the fuel into rotary motion during a power stroke. The power stroke provides driving force for the engine, turning a crank shaft, which in turn performs work through a transmission system that transfers that power to turn the wheels. Conventional combustion engines have widespread adoption, but these engines are inefficient. Around 60 percent or more of the fuel's energy is lost in the internal combustion engine, losing energy to engine friction and shaking, pumping air into and out of the engine, and wasted heat. Modern gasoline engines have a maximum thermal efficiency of about 20% to 35%, when the engine is operating at its point of maximum thermal efficiency. Thus, about 65% to 80% of total power is emitted as heat without being turned into useful work.

The existing designs for internal combustion engines are insufficient, and are in need of improvement. It is therefore desirable to provide novel engines and methods.

SUMMARY OF THE INVENTION

Embodiments of the present invention provide a novel internal combustion engine design and methods for using the same. The internal combustion engine of the present invention may include two rotors on which the pistons and cylinders and pistons are mounted, respectively. A plurality of cylinders mounted on a cylinder rotor, and a plurality of pistons mounted on a piston rod rotor, where the arrangements of the pistons and cylinders are complementary and each piston is paired with one of the cylinders. The cylinder rotor and the piston rod rotor may be position at oblique angle relative to one another, such that their central axes are located on a same plane, but the axes are not coaxially aligned and intersect on that plane. The relative angle between the central axes of the piston rotor and the cylinder rotor may be in a range of about 120° to about 160°. The piston rotor and the cylinder rotor are operable to rotate at the same rotation speed in coordinated fashion such that the pistons and cylinders remain paired and aligned along one plane (e.g., a vertical plane). This angle results in the piston of each pair moving in and out of the cylinder as the piston rotor and the cylinder rotor rotate in synchrony. Thus, as the cylinder rotor and piston rotor rotate, the pistons orbit about the rotation axis of the piston rotor at angle such that the distance from the piston to the cylinder rotor is greatest at the bottom position of the rotational path of the piston rotor and the distance from the cylinder rotor is least at the top of the rotational path of the piston rotor. As a result, the free volume of the corresponding cylinder is greatest at the bottom of the rotational path and smallest at the top of the rotational path. Due to the relative angle of the piston and cylinder rotors, each piston and cylinder combination undergoes one stroke for every 180° rotation of the piston and cylinder rotors. Thus, compression and expansion of gases in the cylinders can take place with a continuous motion of both the cylinder rotors and the piston rotor to eliminate the loss of efficiency of a conventional engine.

The engine of the present invention may operate as a four-stroke internal combustion engine. The combustion cycle of the engine may be as follows:

- Intake stroke: an empty piston and cylinder combination traveling 180° from the top position of the rotational path (e.g., top dead center) to the bottom position (e.g., bottom dead center) may undergo the intake stroke as the volume in the cylinder goes from its smallest to largest condition without exhaust gas in the cylinder, thereby creating a vacuum in the cylinder to draw in a fuel (e.g., an air-fuel mixture, a natural gas fuel, etc.).
- Compression stroke: the piston and cylinder combination filled with fuel traveling 180° from the bottom position of the rotational path to the top position may undergo the compression stroke as the fuel in the cylinder is compressed as the volume in the cylinder goes from its largest to smallest condition thereby compressing the fuel to a high pressure condition.
- Power stroke: a spark plug or other ignition source delivers a spark into the cylinder filled with highly compressed fuel as the piston and cylinder combination are present at the top position of the rotational path. The spark ignites the compressed fuel resulting in an explosive force that propels the piston head toward the distal end of the cylinder. The power stroke is the force driving the rotation of the engine and occupies a 180° rotation of the cylinder and piston rotors, placing them at the bottom position of the rotational path.
- Exhaust stroke: the piston and cylinder combination filled with exhaust gas traveling 180° from the bottom position of the rotational path to the top position may undergo the exhaust stroke as the exhaust gas in the cylinder is pushed of the cylinder as the exhaust valve is opened and the volume in the cylinder goes from its largest to smallest condition thereby pushing the exhaust gas out of the cylinder by increasing the pressure on the exhaust gas.

The rotation of the cylinder rotor may drive a power shaft that provides power to a transmission for use in powering a motor vehicle, a pump, a generator, or other system that can be driven by a shaft. The rotational operation of the engine provides a more efficient utilization of the power stroke of the engine, creating rotational momentum in the absence the series of joints, as found between the piston and cam shaft of a conventional four-stroke engine, to transmit the energy from the power stroke to a power shaft. The presently disclosed rotary engine eliminates substantial amounts of wasted vibrational and frictional energy loss that is typical of the reciprocating action of conventional internal combustion engines.

The cylinder and piston rotors may be plate structures that are positioned at an oblique angle relative to one another (e.g., in a range of about 120° to about 160°) with their respective pistons and cylinders extending orthogonally or substantially orthogonally from the rotors and meeting at a central plane (e.g., a vertical plane) that may be a predetermined distance between the cylinder and piston rotors. In an exemplary embodiment, the central plane may be equidistant from the piston rotor and the cylinder rotor. In some embodiments the angle of the cylinder and piston rotors may be the same relative to the central plane. In other embodiments, the respective angles of the cylinder and piston rotors may be different, but may not vary from each other by more than about 5°. The angled arrangement of the cylinder and piston rotors creates an oscillating distance between corresponding piston heads and cylinders as the cylinder and piston rotors synchronously rotate. At top dead center (e.g., at the top rotational path), the cylinder rotor and the piston rotor are in their closest proximity and the piston head is fully inserted into the corresponding cylinder. As the paired cylinder and piston rotate away from top dead center, they progressively move apart until they reach the bottom dead center position (e.g., at the bottom of the rotational path) 180° from top dead center. Then as the paired cylinder and piston rotate back toward the top of the rotational path, the piston and cylinder progressively move together.

The cylinders may be fixedly connected to the cylinder rotor in an orthogonal or substantially orthogonal orientation. The cylinders may be positioned in various arrangements, which correspond to the arrangement of the piston rods on the piston rotor. For example, and without limitation, the cylinders may include three cylinders in a triangular pattern, four cylinders in a square pattern, five cylinders equidistantly arranged around the perimeter of the cylinder rotor, six cylinders arranged equidistantly around the perimeter of the cylinder rotor, and other arrangements. The piston rods may be arranged in a corresponding pattern on the piston rotor. The piston rotor may have piston rods connected thereto in various arrangements, but one that corresponds to the arrangement of cylinders on the cylinder rotor. For example, and without limitation, the piston rods may include three rods in a triangular pattern, four rods in a square pattern, five rods equidistantly arranged around the perimeter of the piston rotor, six rods arranged equidistantly around the perimeter of the piston rotor, and other arrangements. With a greater number of piston and piston chamber combinations the more power can be provided by the engine and also more constant power such that the engine does not rely on momentum in between power strokes of the pistons.

The piston heads may be connected to the piston rod by movable joints. To accommodate the angled arrangement of the piston rotor and the cylinder rotor, the piston heads may be connected to the rods by a movable joint, such as a ball joint to allow 360° rotation with two degrees of freedom relative to the ball joint. The angling of the piston rod relative to the cylinder axis may be limited to about 30° or less within a limited angle range relative to the central axis of the corresponding cylinder (e.g., within a cone having an apex angle of 30° or less) allowing limited movement to accommodate the geometry of the piston cylinder. Other similar mechanical connections between the piston head and piston rod are contemplated within the scope of the present invention as well. The moveable joint may allow for the piston heads reciprocate in and out of the cylinder with sufficient clearances between the piston rods and the walls of the cylinders without interference or seizing.

The piston rods may be connected to the piston rotor by either fixed connection or movable joints. The angled arrangement of the piston rotor and the cylinder rotor and the joints between the piston rods and piston heads may allow for the pistons to be fixed to the piston rotor in an orthogonal manner, with sufficient clearances between the piston rods and the walls of the cylinders without interference or seizing. In other examples, and without limitation, the piston rods may be connected by a movable joint. In one example, the piston rod may be connected to the rod rotor by a pivoting joint with one degree of freedom (e.g., a hinge joint), which may allow for some limited shifting of the piston rod (e.g., inward and outward relative to the center of the piston rotor) to accommodate the geometry of the corresponding piston chamber. This allows the piston rotor to rotate in unison with the cylinder rotor. In other embodiments, other joints such as a ball joint or a universal joint may be used in combination with extending the piston shaft and the cylinder into the center between both rotors and adding a universal joint at the angle where both shafts meet. This arrangement will also allow both rotors to turn in unison.

In another example, the piston rods may each be connected to the piston rotor by a ball joint to allow 360° rotation two degrees of freedom relative to the ball joint. The angling of the piston rod relative to the piston rotor may be limited to about 10° or less within a limited angle range (e.g., within a cone having an apex angle of 10° or less) allowing limited movement to aid in accommodating the geometry of the piston chamber. Other similar mechanical connections between the piston rod and the piston rotor are contemplated within the scope of the present invention as well.

The cylinder rotor may be in mechanical connection with a power shaft that translates the rotation of the cylinder rotor to a transmission system to utilize the power generated by the engine. The power shaft may be fixedly connected to the cylinder rotor such that they rotate together at the same rotational velocity. The intake and exhaust systems may also be positioned on the cylinder rotor such that they rotate with the cylinder rotor as well. The cylinder rotor may include both intake ports for intake of air-fuel mixture during the intake stroke and exhaust ports to expel the combustion exhaust gas during the exhaust stroke. Each cylinder may have at least one intake port and at least one exhaust port in the cylinder rotor at the top of the cylinder.

The intake system may include an intake manifold for delivering the fuel (e.g., an air fuel mixture) to the intake valve associated with each cylinder. The intake manifold may take the form of a tubular ring chamber positioned at predetermined radius relative to the power shaft and may be in alignment with the intake ports and valves for the cylinders. The ring chamber may have a substantially circular cross-section. In some embodiments (e.g., embodiments in which conventional gasoline is used as the fuel), the ring chamber may include a receiving channel along its entire length on an opposite side thereof from the cylinder rotor. The receiving channel may be configured to receive a throttle ring having a complementary shape to that of the receiving channel such that the throttle ring can be adjustably nested within the receiving channel. An adjustable gap may be present between the throttle ring and the receiving channel for allowing air to flow into the ring chamber to provide the air in the air-fuel mixture. The throttle control of the engine may adjust the proximity of the throttle ring in order to adjust the choke of the engine. The air may be provided by an air conduit into the area of the intake system. The throttle ring may be in static position relative to the cylinder rotor with the gap between the receiving channel and the throttle ring allowing for the rotation of the ring chamber, while the throttle ring remains static. In other embodiments, the engine can be used with other types of fuel, such as alcohol, methane, propane, other natural gas-based fuels, diesel, hydrogen, and other appropriate fuels. Adjustments to the fuel delivery system may be made for such fuels.

The throttle ring may be attached to the motor frame via biased connections that bias the throttle ring toward the closed position. For example, the throttle ring may be connected to the motor frame via studs and biasing springs biasing the throttle ring toward the closed position. The studs may include stops that prevent the throttle ring from contacting the receiving channel of the ring chamber, preventing full choke and seizing between the throttle ring and the ring chamber. The engine may have a throttle control in mechanical connection with the throttle ring, allowing an operator to adjust the proximity of the throttle ring to the ring chamber, and thereby adjust the choke of the engine.

A fuel injector may be connected to the throttle ring for passing fuel into the ring chamber. The fuel injector may be positioned over the point at which the intake valve is opened during the intake stroke and the intake port is exposed allowing the passage of the fuel (e.g., an air-fuel mixture) through the intake port. The fuel injector may be timed to spray fuel into the ring chamber as the intake valve opens, allowing fuel (e.g., the air-fuel mixture) through the intake port and into the open cylinder.

Air may be introduced into the intake system through the gap between the throttle ring and the ring chamber via passages in the engine housing around the intake system. The passages may be located in the engine housing peripherally to the side of the cylinder rotor that faces away from the central plane where the pistons and cylinders meet. The passages may circulate cooling air drawn into the engine housing. For example, and without limitation, the air may be drawn into passages through the housing positioned axially of each cylinder block and discharged through apertures through the housing positioned radially on housing. In some embodiments, the passages may include fins and slots are formed in the passages to impart rotation and/or direct flow of the air.

An intake valve may control the passage of the air-fuel mixture through the intake port into the corresponding cylinder during the intake stroke. In some embodiments, the intake valve may be operated and opened by negative pressure during the intake stroke, and the intake valve may remain closed during the other stages of the combustion cycle. In some embodiments, the low pressure generated in the cylinder during the intake stroke may be sufficient to open an intake valve for the cylinder to allow the entry of the fuel. The intake valve may include a seated structure in the intake port that is held in the seated position by a biasing device, such as a spring that biases the structure to the closed position. The force applied by the biasing device to the valve structure may be overcome by the vacuum in the cylinder during the intake stroke. The valve structure may be a poppet valve structure with a corresponding spring. In some examples, the valve head may be nested in the intake port, such that it does not interfere with other parts of the engine. In other embodiments, each cylinder may have an intake valve actuated by a mechanical timing mechanism operable to open the valve.

An exhaust valve may control the passage of the exhaust gas through the exhaust port into an exhaust conduit during the exhaust stroke. The exhaust valve may be operated and opened by a cam system that is in mechanical connection with the rotating cylinder rotor, e.g., through a gearing system that times the cam such that it opens the exhaust valve at the exhaust stroke for the corresponding cylinder. In some embodiments, the cam system may include gearing with a ratio that allows it to spin at half of the rotational speed of the cylinder rotor. In such embodiments, the cam system may include a drum that rotates in the same direction as the power shaft at one half the rotational speed of the cylinder rotor, and may turn freely with respect to the power shaft on a bearing. In such embodiments, four cam lobes may protrude from the drum to engage the valve push rods or other engagement structures of the exhaust valves of each of the paired pistons and cylinders. The cams may be structured such that a cam opens the exhaust valve for a particular cylinder when the corresponding piston is at bottom dead center and keeps the exhaust valve open until the corresponding piston reaches top dead center (e.g., the cam lobe may have a length of nearly about ¼ of the circumference of the drum). The cam drum may be rotated by a gearing system that accomplishes rotational speed that is one half of the speed of the cylinder rotor. The combination of the about ¼ turn cam lobes and the ½ ratio of cam drum rotation to cylinder rotor rotation allows for the exhaust valve to be open for the most to about all of the exhaust stroke, since the about ¼ turn length of the cam lobe engages the exhaust valve while the cylinder valve rotates 180°. The cam lobes may be staggered along the axial dimension of the drum and the exhaust valve push rods may be correspondingly staggered such that each cam lobe only engages with the exhaust valve of a particular cylinder, allowing the exhaust valves to remain closed during the other stages of the combustion cycle.

An exhaust conduit may be connected to each of the cylinders for passing the exhaust gas to an exhaust manifold that delivers the exhaust gas into an exhaust collection pipe. In some embodiments, the exhaust manifold may be incorporated into the power shaft, where each of the exhaust conduits routes from the exhaust port of the corresponding cylinder radially inward toward the power shaft. The exhaust conduits may connect with an exhaust manifold, which may be a cylindrical collar around the power shaft at or near the cylinder rotor. The exhaust conduits may connect with a port in the exhaust manifold that is in fluid connection with an exhaust pipe that rotates with the power shaft. In some embodiments, the exhaust pipe may be nested within the power shaft.

The engine may include a support shaft for the piston rotor as well, which may be mounted to the engine block and allow the piston rotor to freely spin as the engine operates. IN some embodiments the piston rotor may be engaged with other elements of the engine or other systems (e.g., a battery charging system, fan systems, etc.) to utilize the energy provided by the rotation of the piston rotor. For example, the piston rotor may be connected to a rotating shaft that nests in the support shaft and passes through the engine housing to the exterior of the engine housing to allow for direct or geared attachment to provide power for another system.

The engine may include an oil pump for providing lubrication to the engine. The oil pump may include a spraying mechanism that delivers oil into the area of the pistons and cylinders to lubricate the structures as they rotate. The spraying mechanism may provide a large volume of oil into the area of the pistons and rotors. For example, and without limitation, the oil pump may draw oil from a sump located at the center of the engine housing and below the pistons and cylinders and the spraying mechanism may be positioned to deliver oil upwards against a cowling in the engine housing and into the area of the pistons and cylinders. The cowling may include grooves into which the oil is delivered that allow for limited retention of the sprayed oil to facilitate thermal transfer between the oil and the wall of the engine housing. The cowling may comprise a highly conductive metal, such as aluminum, aluminum alloys, and other highly conductive materials. To further facilitate thermal transfer, the engine housing may include cooling fins on the exterior thereof in close proximity to the cowling to allow heat to radiate therefrom. The engine may also include a fan system that provides air to the area of the cooling fins.

The paired rotor design of the present invention may be included in other types of devices and applied to other functions. For example, in some embodiments, the presently disclose rotor arrangement may be incorporated into a pumping system. Such a pumping system may use the reciprocal action of the pistons and cylinders to pressurize and pump fluids (e.g., gases such as oxygen gas, hydrogen gas, etc., liquids such as water, lubricants, effluent, etc.) into a system operable to utilize such fluids. Such a pumping system may include cylinder and piston rotors positioned at an oblique angle relative to one another (e.g., in a range of about 120° to about 160°) with their respective pistons and cylinders extending orthogonally or substantially orthogonally from the rotors and meeting at a central plane (e.g., a vertical plane) that may be a pre-determined distance between the cylinder and piston rotors. For example, the central plane may be equidistant from the piston rotor and the cylinder rotor. In some embodiments the angle of the cylinder and piston rotors may be the same relative to the central plane. In other embodiments, the respective angles of the cylinder and piston rotors may be different, but may not vary from each other by more than about 5°. The angled arrangement of the cylinder and piston rotors creates an oscillating distance between corresponding piston heads and cylinders as the cylinder and piston rotors synchronously rotate. The cylinders may be fixedly connected to the cylinder rotor in an orthogonal or substantially orthogonal orientation. The cylinders may be positioned in various arrangements, which correspond to the arrangement of the piston rods on the piston rotor. For example, and without limitation, the cylinders may include three cylinders in a triangular pattern, four cylinders in a square pattern, five cylinders equidistantly arranged around the perimeter of the cylinder rotor, six cylinders arranged equidistantly around the perimeter of the cylinder rotor, and other arrangements. The piston rods may be arranged in a corresponding pattern on the piston rotor. The piston rotor may have piston rods connected thereto in various arrangements, but one that corresponds to the arrangement of cylinders on the cylinder rotor. For example, and without limitation, the piston rods may include three rods in a triangular pattern, four rods in a square pattern, five rods equidistantly arranged around the perimeter of the piston rotor, six rods arranged equidistantly around the perimeter of the piston rotor, and other arrangements. With a greater number of piston and piston chamber combinations the more fluid can be provided by the pumping system per rotation of the rotors.

As discussed with respect to other embodiments, the piston heads may be connected to the piston rod by movable joints. To accommodate the angled arrangement of the piston rotor and the cylinder rotor, the piston heads may be connected to the rods by a movable joint, such as a ball joint to allow 360° rotation with two degrees of freedom relative to the ball joint. The angling of the piston rod relative to the cylinder axis may be limited to about 30° or less within a limited angle range relative to the central axis of the corresponding cylinder (e.g., within a cone having an apex angle of 30° or less) allowing limited movement to accommodate the geometry of the piston cylinder. Other similar mechanical connections between the piston head and piston rod are contemplated within the scope of the present invention as well. The moveable joint may allow for the piston heads reciprocate in and out of the cylinder with sufficient clearances between the piston rods and the walls of the cylinders without interference or seizing. The piston rods may be connected to the piston rotor by either fixed connection or movable joints, as discussed herein. The angled arrangement of the piston rotor and the cylinder rotor and the joints between the piston rods and piston heads may allow for the pistons to be fixed to the piston rotor in an orthogonal manner, with sufficient clearances between the piston rods and the walls of the cylinders without interference or seizing. In other examples, and without limitation, the piston rods may be connected by a movable joint. In one example, the piston rod may be connected to the rod rotor by a pivoting joint with one degree of freedom (e.g., a hinge joint), which may allow for some limited shifting of the piston rod (e.g., inward and outward relative to the center of the piston rotor) to accommodate the geometry of the corresponding piston chamber. This allows the piston rotor to rotate in unison with the cylinder rotor. In other embodiments, other joints such as a ball joint or a universal joint may be used in combination with extending the piston shaft and the cylinder into the center between both rotors and adding a universal joint at the angle where both shafts meet. This arrangement will also allow both rotors to turn in unison.

In another example, the piston rods may each be connected to the piston rotor by a ball joint to allow 360° rotation two degrees of freedom relative to the ball joint. The angling of the piston rod relative to the piston rotor may be limited to about 10° or less within a limited angle range (e.g., within a cone having an apex angle of 10° or less) allowing limited movement to aid in accommodating the geometry of the piston chamber. Other similar mechanical connections between the piston rod and the piston rotor are contemplated within the scope of the present invention as well.

The cylinder rotor may be in mechanical connection with a drive shaft that rotates either the piston rotor or cylinder rotor to drive the rotation and reciprocal motion of the pistons and cylinders to thereby pump fluid from the cylinders into an exit (exhaust) conduit to deliver the fluid to a system that utilizes the fluid. The drive shaft may be fixedly connected to the rotor such that they rotate together at the same rotational velocity. The cylinder rotor may include exit (exhaust) ports to expel the fluid into the exit conduits. Each cylinder may have at least one exit port in the cylinder rotor (e.g., at the top of the cylinder).

The apparatus may also include an intake system delivering fluid into the chambers. The intake system may include intake ports or valves for intake of the fluid into the chambers. The intake system may also include an intake manifold for delivering the fluid to an intake valve or port associated with each cylinder. The intake manifold may take the form of a tubular ring chamber positioned at predetermined radius relative to the drive shaft and may be in alignment with the intake ports and valves for the cylinders. Both the intake and exhaust systems may also be positioned on the cylinder rotor such that they rotate with the cylinder rotor.

In some embodiments, the apparatus may include exit (exhaust) valves to control the passage of the fluid through the exit port into an exit (exhaust) conduit. The exit valve may be operated and opened by a cam system that is in mechanical connection with the rotating cylinder rotor, e.g., through a gearing system that times the cam such that it opens the exit valve when the piston head is fully or substantially fully inserted into the cylinder. In such embodiments, the cam system may include a drum that rotates in the same direction as the drive shaft (e.g., at the same rotational speed as the cylinder rotor), and may turn freely with respect to the drive shaft on a bearing. In such embodiments, four cam lobes may protrude from the drum to engage the valve push rods or other engagement structures of the exit valves of each of the paired pistons and cylinders. The cams may be structured such that a cam opens the exit valve for a particular cylinder when the corresponding piston is at bottom dead center and keeps the exit valve open until the corresponding piston reaches top dead center (e.g., the cam lobe may have a length of nearly about ¼ of the circumference of the drum). The cam drum may be rotated by a gearing system that accomplishes rotational speed that is one half of the speed of the cylinder rotor. The cam lobes may be staggered along the axial dimension of the drum and the exit valve push rods may be correspondingly staggered such that each cam lobe only engages with the exit valve of a particular cylinder, allowing the exit valves to remain closed during the other stages of the combustion cycle.

An exit conduit may be connected to each of the cylinders for passing the exit gas to an exhaust manifold that delivers the fluid into a fluid collection pipe. In some embodiments, the exhaust manifold may be incorporated into the drive shaft, where each of the exit conduits routes from the exit port of the corresponding cylinder radially inward toward the drive shaft. The exit conduits may connect with an exhaust manifold, which may be a cylindrical collar around the drive shaft at or near the cylinder rotor. The exit conduits may connect with a port in the exhaust manifold that is in fluid connection with an exit pipe that rotates with the drive shaft. In some embodiments, the exit pipe may be nested within the drive shaft.

It is an object of the invention to provide a rotary engine design that increases the efficiency of combustion engines. It is a further object of the present invention to provide apparatuses having pairs of rotating angled pistons and cylinders to create reciprocal motion that can be used in internal combustion engines, pumps, and other applications. Additional aspects and objects of the invention will be apparent from the detailed descriptions and the claims herein.

In one aspect, the present invention relates to a rotary engine, comprising a piston rotor having a plurality of pistons thereon and positioned on a first rotational axis; a cylinder rotor having a plurality of cylinders thereon and positioned on a second rotational axis; and a power shaft for transmitting rotational motion from one of the piston rotor and cylinder rotor to a transmission system for providing mechanical power to another system, where the first rotational axis and the second rotational axis are oblique relative to one another, and each of the plurality of pistons is nested in one of the plurality of cylinders and the rotation of the piston rotor and the cylinder rotor is driven by combustion of a fuel in the cylinders. The first and second rotational axes may be positioned on a same plane. The angle between the first rotational axis and the second rotational axis may be in a range of about 120° to about 160°. The pistons may each include a piston head connected to a piston rod by a movable joint. The movable joint may be a ball joint. The piston rod may be connected to the piston rotor by a movable joint. The piston rod may be fixedly attached to the piston rotor. The piston rod may be substantially orthogonal to the surface of the piston rotor. Due to the angle of the relative angle of the piston rotor and the cylinder rotor, synchronous rotation of the piston rotor and the cylinder rotor may result in a reciprocating motion of each piston within the corresponding cylinder, where the piston head of each piston penetrates furthest into the corresponding cylinder at a proximal point in its rotational path that is nearest to the cylinder rotor and the piston is at its most retracted point in corresponding cylinder at a distal point in its rotational path that is furthest from the cylinder rotor. The combustion may occur at or near the proximal point. The piston head may be at top dead center at the proximal point. The intake may occur at or near the distal point. The piston head may be at bottom dead center at the distal point. The engine may be a four-stroke engine and the combustion cycle may be completed in two full rotations of the piston rotor and the cylinder rotor. Each stroke of the combustion cycle may occur over a 180° turn of the piston rotor and cylinder rotor.

The engine may further include a fuel intake system comprising an intake manifold and a throttle mechanism. The intake manifold may include a tube that is connected to the cylinder rotor and rotates with the cylinder rotor. The tube may have a substantially circular cross-section and has a ring shape that is concentric with the cylinder rotor and includes fuel delivery passages that are in fluid communication with each of the plurality of cylinders in the cylinder rotor. The tube may include a channel that runs the entire length of the tube on the side of the tube opposite from the cylinder rotor. The engine may further include a throttle system that includes throttle ring having a cross-sectional shape that is complementary to the channel in the tube, and a throttle control that is operable to move the throttle ring in and out of the channel to adjust the amount of allowed to flow into the tube. The engine may further include a fuel injector for injecting fuel into the tube, wherein the fuel injector is connected to the throttle ring and is positioned to inject fuel directly into the tube. The throttle ring and the fuel injector are stationary with respect to the cylinder rotor and the tube. Each of the plurality of cylinders may include an intake valve in fluid communication with the tube, and is opened by the vacuum created by an intake stroke of a corresponding piston.

The engine may further include an exhaust system comprising an exhaust manifold and an exhaust valve timing mechanism. Each of the plurality of cylinders includes an exhaust valve in fluid communication with the cylinder an exhaust conduit, wherein the exhaust conduit is in fluid communication with the exhaust manifold. The exhaust manifold may be mounted on the power shaft and rotates with the power shaft. The exhaust conduits may be connected to the cylinder rotor and rotate with the cylinder rotor. The exhaust conduits may connect ports in the exhaust manifold that are in fluid communication with an exhaust pipe that routes exhaust out of the engine. The exhaust pipe may rotate with the power shaft. The exhaust pipe may be nested in the power shaft. The exhaust valve timing system may include a cam drum that rotates independently of the power shaft. The cam drum may be in direct mechanical communication with the cylinder rotor via a gearing system that rotates the cam drum at a pre-determined speed relative to the cylinder rotor. The cam drum may include at least one cam for actuating the exhaust valve of each of the plurality of cylinders, wherein the at least one cam actuates the exhaust valve of each of the plurality of cylinders during exhaust stroke.

In a second aspect, the present invention relates to a rotary engine, comprising a piston rotor having a plurality of pistons thereon and positioned on a first rotational axis; and a cylinder rotor having a plurality of cylinders thereon and positioned on a second rotational axis, wherein the first rotational axis and the second rotational axis are oblique relative to one another, and each of the plurality of pistons is nested in one of the plurality of cylinders and the rotation of the piston rotor and the cylinder rotor is driven by combustion of a fuel in the cylinders. The engine may further include a power shaft for transmitting rotational motion from one of the piston rotor and cylinder rotor to a transmission system for providing mechanical power to another system. The first and second rotational axes may be positioned on a same plane. The angle between the first rotational axis and the second rotational axis may be in a range of about 120° to about 160°. The pistons may each include a piston head connected to a piston rod by a movable joint. The movable joint may be a ball joint. The piston rod may be connected to the piston rotor by a movable joint. The piston rod may be fixedly attached to the piston rotor. The piston rod may be substantially orthogonal to the surface of the piston rotor. Due to the angle of the relative angle of the piston rotor and the cylinder rotor, synchronous rotation of the piston rotor and the cylinder rotor may result in a reciprocating motion of each piston within the corresponding cylinder, where the piston head of each piston penetrates furthest into the corresponding cylinder at a proximal point in its rotational path that is nearest to the cylinder rotor and the piston is at its most retracted point in corresponding cylinder at a distal point in its rotational path that is furthest from the cylinder rotor. The combustion may occur at or near the proximal point. The piston head may be at top dead center at the proximal point. The intake may occur at or near the distal point. The piston head may be at bottom dead center at the distal point. The engine may be a four-stroke engine and the combustion cycle may be completed in two full rotations of the piston rotor and the cylinder rotor. Each stroke of the combustion cycle may occur over a 180° turn of the piston rotor and cylinder rotor.

The engine may further include a fuel intake system comprising an intake manifold and a throttle mechanism. The intake manifold may include a tube that is connected to the cylinder rotor and rotates with the cylinder rotor. The tube may have a substantially circular cross-section and has a ring shape that is concentric with the cylinder rotor and includes fuel delivery passages that are in fluid communication with each of the plurality of cylinders in the cylinder rotor. The tube may include a channel that runs the entire length of the tube on the side of the tube opposite from the cylinder rotor. The engine may further include a throttle system that includes throttle ring having a cross-sectional shape that is complementary to the channel in the tube, and a throttle control that is operable to move the throttle ring in and out of the channel to adjust the amount of allowed to flow into the tube. The engine may further include a fuel injector for injecting fuel into the tube, wherein the fuel injector is connected to the throttle ring and is positioned to inject fuel directly into the tube. The throttle ring and the fuel injector are stationary with respect to the cylinder rotor and the tube. Each of the plurality of cylinders may include an intake valve in fluid communication with the tube, and is opened by the vacuum created by an intake stroke of a corresponding piston.

The engine may further include an exhaust system comprising an exhaust manifold and an exhaust valve timing mechanism. Each of the plurality of cylinders includes an exhaust valve in fluid communication with the cylinder an exhaust conduit, wherein the exhaust conduit is in fluid communication with the exhaust manifold. The exhaust manifold may be mounted on the power shaft and rotates with the power shaft. The exhaust conduits may be connected to the cylinder rotor and rotate with the cylinder rotor. The exhaust conduits may connect ports in the exhaust manifold that are in fluid communication with an exhaust pipe that routes exhaust out of the engine. The exhaust pipe may rotate with the power shaft. The exhaust pipe may be nested in the power shaft. The exhaust valve timing system may include a cam drum that rotates independently of the power shaft. The cam drum may be in direct mechanical communication with the cylinder rotor via a gearing system that rotates the cam drum at a pre-determined speed relative to the cylinder rotor. The cam drum may include at least one cam for actuating the exhaust valve of each of the plurality of cylinders, wherein the at least one cam actuates the exhaust valve of each of the plurality of cylinders during exhaust stroke.

In a third aspect, the present invention relates to mechanical apparatus comprising a piston rotor having a plurality of pistons thereon and positioned on a first rotational axis; and a cylinder rotor having a plurality of cylinders thereon and positioned on a second rotational axis, wherein the first rotational axis and the second rotational axis are oblique relative to one another, and each of the plurality of pistons is nested in one of the plurality of cylinders. The first and second rotational axes may be positioned on a same plane. The angle between the first rotational axis and the second rotational axis may be in a range of about 120° to about 160°. The pistons may each include a piston head connected to a piston rod by a movable joint. The movable joint may be a ball joint. The piston rod may be connected to the piston rotor by a movable joint. The piston rod may be fixedly attached to the piston rotor. The piston rod may be substantially orthogonal to the surface of the piston rotor. Due to the angle of the relative angle of the piston rotor and the cylinder rotor, synchronous rotation of the piston rotor and the cylinder rotor results in a reciprocating motion of each piston within the corresponding cylinder, wherein the piston head of each piston penetrates furthest into the corresponding cylinder at a proximal point in its rotational path that is nearest to the cylinder rotor and the piston is at its most retracted point in corresponding cylinder at a distal point in its rotational path that is furthest from the cylinder rotor. The apparatus may further include a fluid intake system comprising an intake manifold. The apparatus may further include a fluid exhaust system comprising an exhaust manifold. Each of the plurality of cylinders may include an exhaust passage in fluid communication with an exhaust conduit, wherein the exhaust conduit is in fluid communication with the exhaust manifold. The exhaust conduits may be connected to the cylinder rotor and rotate with the cylinder rotor. The exhaust conduits may connect ports in the exhaust manifold that are in fluid communication with a fluid exhaust conduit that routes fluid out of the apparatus.

In a fourth aspect, the present invention relates to a method of generating propulsive force, comprising positioning a plurality of pistons connected to a piston rotor positioned on a first rotational axis in a plurality of cylinders positioned on a cylinder rotor positioned on a second rotational axis to form a plurality of paired pistons and cylinders, wherein the first rotational axis and the second rotational axis are oblique relative to one another; and combusting a fuel in the paired pistons and cylinders in a sequential pattern to drive rotation of the piston rotor and the cylinder rotor, wherein the rotation of one of the piston rotor and the cylinder rotor drives rotation of a power shaft for transmitting rotational motion from one of the piston rotor and cylinder rotor to a transmission system for providing mechanical power to another system. The first and second rotational axes may be positioned on a same plane. The angle between the first rotational axis and the second rotational axis may be in a range of about 120° to about 160°. The pistons may each include a piston head connected to a piston rod by a movable joint. The movable joint may be a ball joint. The piston rod may be connected to the piston rotor by a movable joint. The piston rod may be fixedly attached to the piston rotor. The piston rod may be substantially orthogonal to the surface of the piston rotor. Due to the angle of the relative angle of the piston rotor and the cylinder rotor, synchronous rotation of the piston rotor and the cylinder rotor may result in a reciprocating motion of each piston within the corresponding cylinder, where the piston head of each piston penetrates furthest into the corresponding cylinder at a proximal point in its rotational path that is nearest to the cylinder rotor and the piston is at its most retracted point in corresponding cylinder at a distal point in its rotational path that is furthest from the cylinder rotor. The combustion may occur at or near the proximal point. The piston head may be at top dead center at the proximal point. The intake may occur at or near the distal point. The piston head may be at bottom dead center at the distal point. The engine may be a four-stroke engine and the combustion cycle may be completed in two full rotations of the piston rotor and the cylinder rotor. Each stroke of the combustion cycle may occur over a 180° turn of the piston rotor and cylinder rotor.

The engine may further include a fuel intake system comprising an intake manifold and a throttle mechanism. The intake manifold may include a tube that is connected to the cylinder rotor and rotates with the cylinder rotor. The tube may have a substantially circular cross-section and has a ring shape that is concentric with the cylinder rotor and includes fuel delivery passages that are in fluid communication with each of the plurality of cylinders in the cylinder rotor. The tube may include a channel that runs the entire length of the tube on the side of the tube opposite from the cylinder rotor. The engine may further include a throttle system that includes throttle ring having a cross-sectional shape that is complementary to the channel in the tube, and a throttle control that is operable to move the throttle ring in and out of the channel to adjust the amount of allowed to flow into the tube. The engine may further include a fuel injector for injecting fuel into the tube, wherein the fuel injector is connected to the throttle ring and is positioned to inject fuel directly into the tube. The throttle ring and the fuel injector are stationary with respect to the cylinder rotor and the tube. Each of the plurality of cylinders may include an intake valve in fluid communication with the tube, and is opened by the vacuum created by an intake stroke of a corresponding piston.

The engine may further include an exhaust system comprising an exhaust manifold and an exhaust valve timing mechanism. Each of the plurality of cylinders includes an exhaust valve in fluid communication with the cylinder an exhaust conduit, wherein the exhaust conduit is in fluid communication with the exhaust manifold. The exhaust manifold may be mounted on the power shaft and rotates with the power shaft. The exhaust conduits may be connected to the cylinder rotor and rotate with the cylinder rotor. The exhaust conduits may connect ports in the exhaust manifold that are in fluid communication with an exhaust pipe that routes exhaust out of the engine. The exhaust pipe may rotate with the power shaft. The exhaust pipe may be nested in the power shaft. The exhaust valve timing system may include a cam drum that rotates independently of the power shaft. The cam drum may be in direct mechanical communication with the cylinder rotor via a gearing system that rotates the cam drum at a pre-determined speed relative to the cylinder rotor. The cam drum may include at least one cam for actuating the exhaust valve of each of the plurality of cylinders, wherein the at least one cam actuates the exhaust valve of each of the plurality of cylinders during exhaust stroke.

In a fifth aspect, the present invention relates to a method of fluid movement, comprising positioning a plurality of pistons connected to a piston rotor positioned on a first rotational axis in a plurality of cylinders positioned on a cylinder rotor positioned on a second rotational axis to form a plurality of paired pistons and cylinders, wherein the first rotational axis and the second rotational axis are oblique relative to one another; and moving a fluid through the paired pistons and cylinders in a sequential pattern, wherein the rotation of one of the piston rotor and the cylinder rotor results in movement of the fluid from the cylinders into an exhaust system. The first and second rotational axes may be positioned on a same plane. The angle between the first rotational axis and the second rotational axis may be in a range of about 120° to about 160°. The pistons may each include a piston head connected to a piston rod by a movable joint. The movable joint may be a ball joint. The piston rod may be connected to the piston rotor by a movable joint. The piston rod may be fixedly attached to the piston rotor. The piston rod may be substantially orthogonal to the surface of the piston rotor. Due to the angle of the relative angle of the piston rotor and the cylinder rotor, synchronous rotation of the piston rotor and the cylinder rotor may result in a reciprocating motion of each piston within the corresponding cylinder, wherein the piston head of each piston penetrates furthest into the corresponding cylinder at a proximal point in its rotational path that is nearest to the cylinder rotor and the piston is at its most retracted point in corresponding cylinder at a distal point in its rotational path that is furthest from the cylinder rotor.

The paired pistons and rotors may be incorporated into an apparatus that includes a fluid intake system comprising an intake manifold. The intake manifold includes a tube that may be connected to the cylinder rotor and rotates with the cylinder rotor. The tube may have a substantially circular cross-section and has a ring shape that is concentric with the cylinder rotor and includes fluid delivery passages that are in fluid communication with each of the plurality of cylinders in the cylinder rotor. The paired pistons and rotors may be incorporated into an apparatus that includes an exhaust system comprising an exhaust manifold and an exhaust valve timing mechanism. The plurality of cylinders may include an exhaust valve in fluid communication with the cylinder an exhaust conduit, wherein the exhaust conduit is in fluid communication with the exhaust manifold. The exhaust conduits may be connected to the cylinder rotor and rotate with the cylinder rotor. The exhaust conduits may connect to ports in the exhaust manifold that are in fluid communication with an exhaust pipe that routes fluid out of the apparatus.

DETAILED DESCRIPTION

Figure 1:
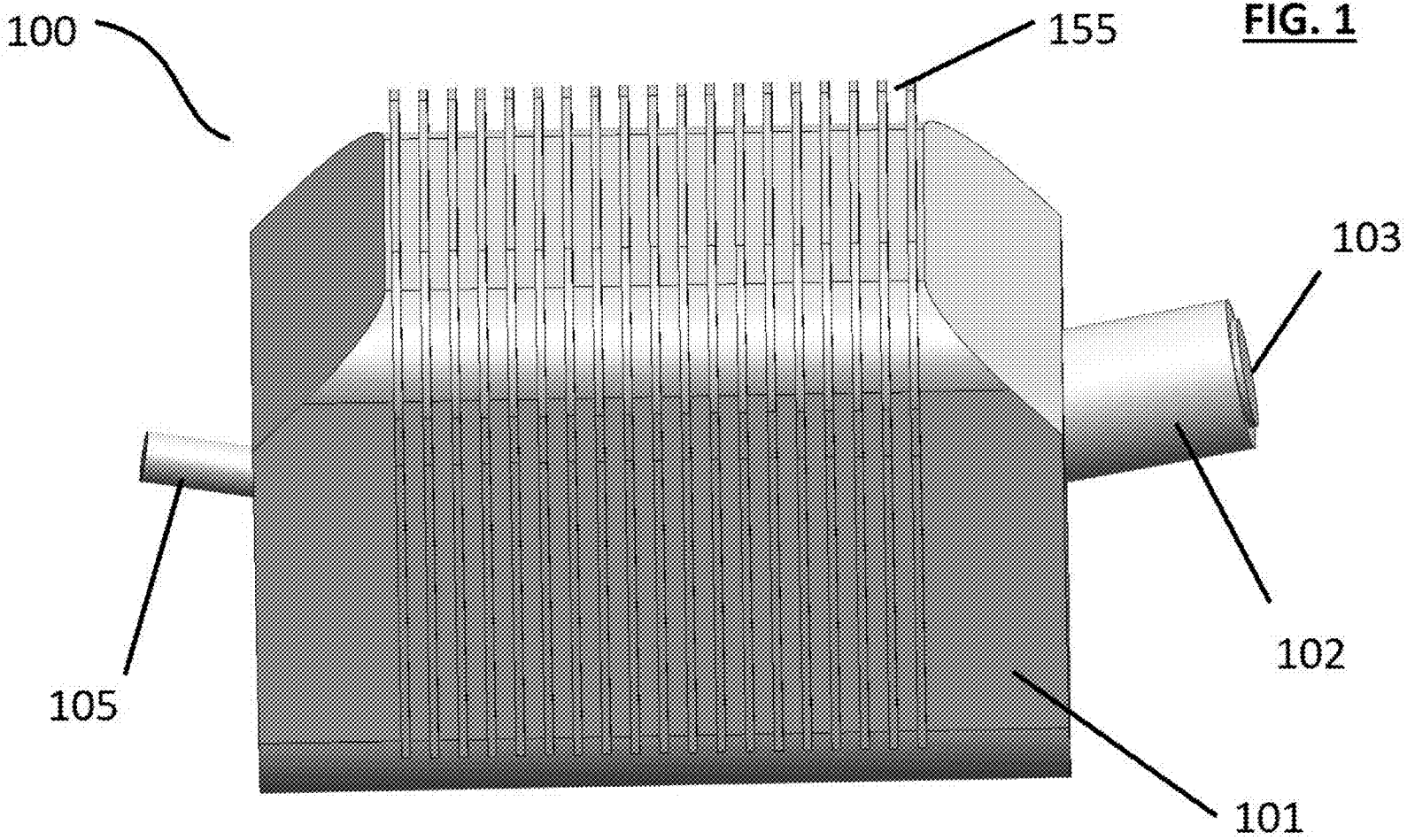
FIG. 1 is a side view of an engine according to an embodiment of the present invention.

Reference will now be made in detail to certain embodiments of the invention, examples of which are illustrated in the accompanying drawings. While the invention will be described in reference to these figures and certain implementations and examples of the embodiments, it will be understood that such implementations and examples are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. References to various features of the "present invention" throughout this document do not mean that all claimed embodiments or methods must include the referenced features. It will be apparent to one skilled in the art that the present invention may be practiced without these specific details or features.

Reference will be made to the exemplary illustrations in the accompanying drawings, and like reference characters may be used to designate like or corresponding parts throughout the several views of the drawings. FIGS. 1-6 provide views of an exemplary embodiment of a novel internal combustion engine having a rotary piston and cylinder design.

The engine of the present invention provides a rotary cylinder and piston system that drives a power shaft to transmit power to a power transmission system for various uses, including powering an automobile, powering a generator, powering a pumping system, and other applications. The engine 100 may be enclosed in an engine housing 101, enclosing the cylinder and piston rotors, as well as other systems, such as the intake and exhaust systems. A power shaft 102 may traverse the engine housing 101 such that it may deliver power to a power transmission assembly (not shown), such as a vehicle transmission. An exhaust pipe 103 may be nested within the power shaft and may allow for the removal of combustion exhaust from the engine housing and may be routed to a venting system. The exhaust pipe 103 may rotate with the power shaft and connect with a stationary system in a downstream location. The power shaft 102 may be in mechanical connection with a cylinder rotor, such that the rotation of the cylinder rotor rotates the power shaft 102. An idler shaft 105 may be present to connect to and hold a piston rotor in position within the engine housing 101 to position the piston rotor in proper orientation relative to the cylinder rotor and allow for free rotation of the piston rotor. The engine 100 may also include an engine cooling system that includes an oil pump and delivery system that works in coordination with cooling fins 155 operable to absorb thermal energy from the interior of the engine 100 and radiate it to the ambient air.

Figure 2:
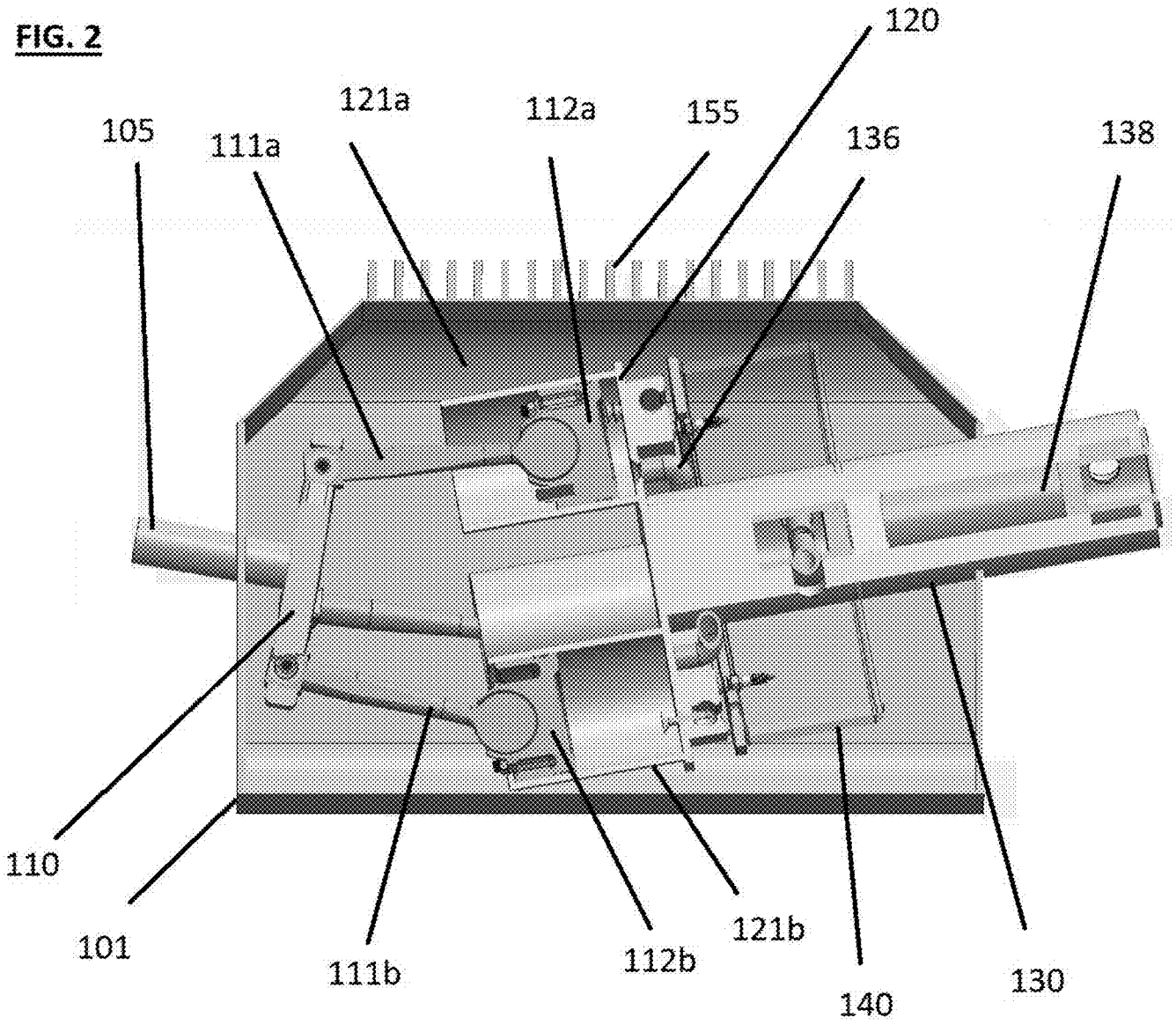
FIG. 2 is a cross-sectional view of an engine according to an embodiment of the present invention.

FIG. 2 provides a cross-sectional view of the engine 100 showing most of the major internal parts of the embodiment. The piston rotor 110 and cylinder rotor 120 are shown in profile positioned at an oblique angle relative to one another within the engine housing 101. The rotors meet at a central plane (e.g., a vertical plane) that may be a pre-determined distance between the cylinder rotor 120 and piston rotor 110. In the embodiment shown in the FIGS., the central plane may be equidistant from the piston rotor 110 and the cylinder rotor 120. The angles of the cylinder rotor 120 and piston rotor 110 may be the same relative to the central plane. The angled arrangement of the cylinder rotor 120 and the piston rotor 110 creates an oscillating distance between corresponding piston heads and cylinders as the cylinder and piston rotors synchronously rotate. As shown in FIG. 2, there are multiple pistons 111*a* and 111*b* connected to the piston rotor 110. The pistons 111*a* and 111*b* include piston heads 112*a* and 112*b* nested in cylinders 121*a* and 121*b*. At the top of the rotational path of the pistons and cylinders, where piston head 111*a* and cylinder 121*a* are positioned in FIG. 2, the piston head 112*a* is at top dead center. At this position, the cylinder rotor 120 and the piston rotor 110 are in their closest proximity and the piston head 112*a* is fully inserted into the corresponding cylinder 121*a*. As the paired cylinder 121*a* and piston 111*a* rotate away from top dead center, they progressively move apart until they reach the bottom of the rotational path 180° from top dead center (at bottom dead center), where piston 111*b* and corresponding cylinder 121*b* are positioned in FIG. 2. As the paired cylinder and piston rotate back toward the top of the rotational path, the piston and cylinder progressively move together.

As shown in FIG. 2, the cylinders 121 may be fixedly connected to a cylinder rotor 120 in an orthogonal or substantially orthogonal orientation. In the embodiment shown in the FIGS., the cylinders 121 may be positioned in a square arrangement of four cylinders with cylinders arranged equidistantly around the perimeter of the cylinder rotor 120. The piston rods of pistons 111 may be arranged in a corresponding pattern on the piston rotor 110. In the embodiment shown in the FIGS., the piston rods 112 may be connected to the piston rotor 110 by movable joints with one degree of freedom, for example a pivoting joint.

The piston heads 112*a* and 112*b* may be connected to the corresponding piston rods 111*a* and 111*b* by movable joints. To accommodate the angled arrangement of the piston rotor 110 and the cylinder rotor 120, the piston heads 112 may be connected to the rods by a movable joint, such as a ball joint to allow 360° rotation with two degrees of freedom relative to the ball joint. The angling of the piston rods 111 relative to the axes of the cylinders 121 may be limited to about 30° or less within a limited angle range relative to the central axis of the corresponding cylinder 121, allowing limited movement to accommodate the geometry of the piston cylinder 121. The moveable joint may allow for the piston heads 112 to reciprocate in and out of the corresponding cylinder 121 with sufficient clearances between the piston rods and the walls of the cylinders without interference or seizing.

Figure 3:
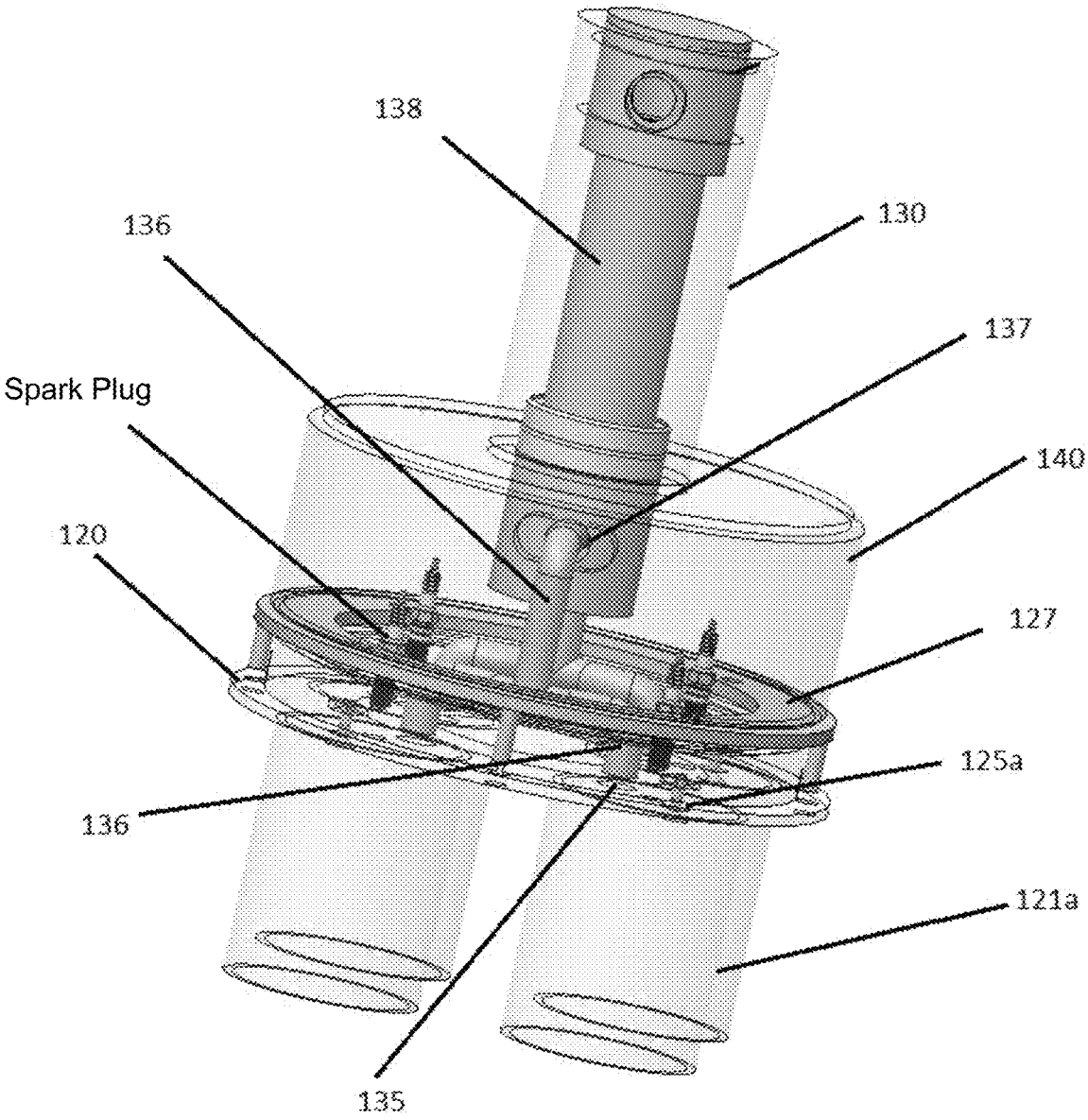
FIG. 3 is a perspective view of component systems of an engine according to an embodiment of the present invention.
Figure 4A:
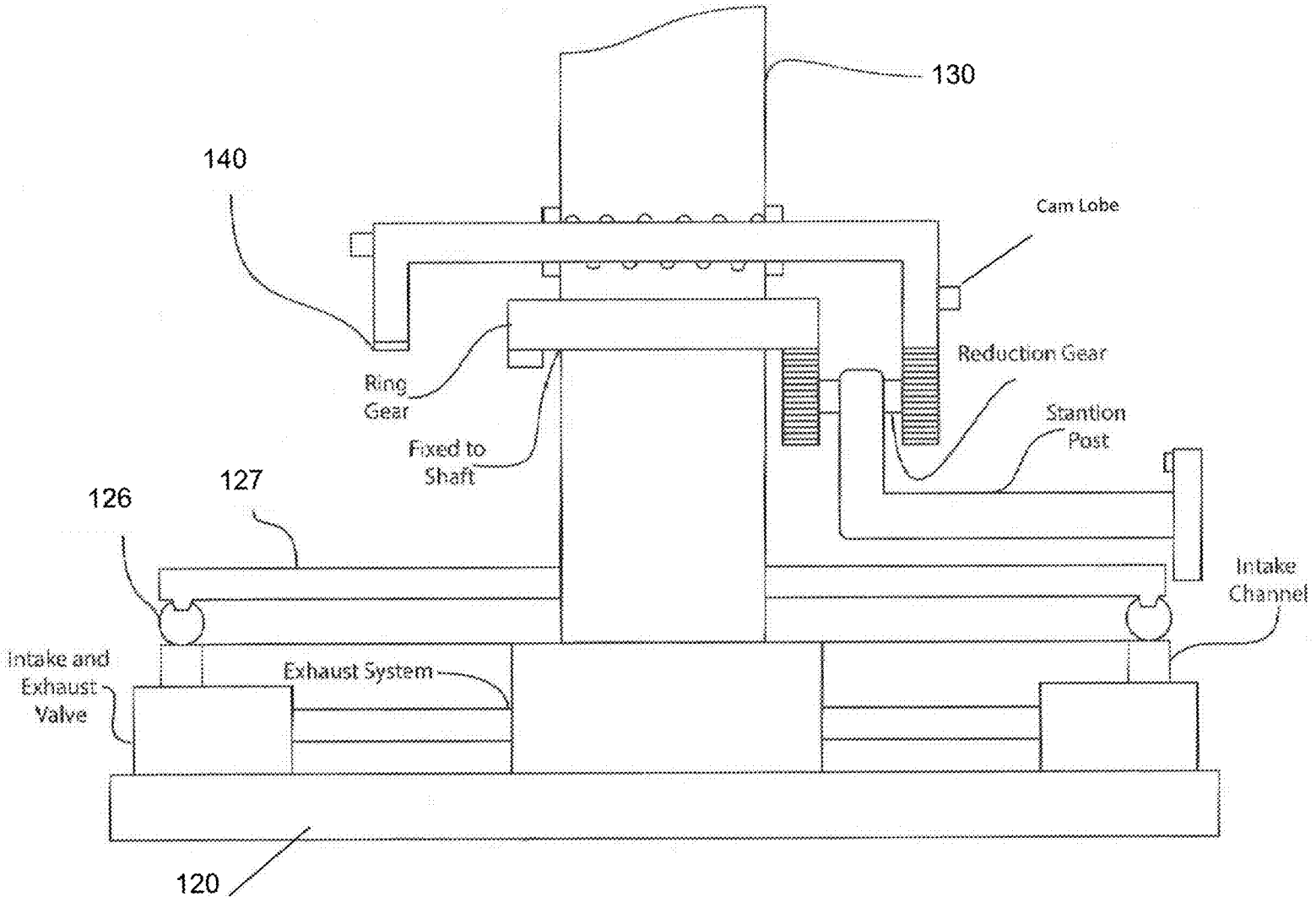
FIG. 4A is a cross-sectional view of component systems of an engine according to an embodiment of the present invention.
Figure 4B:
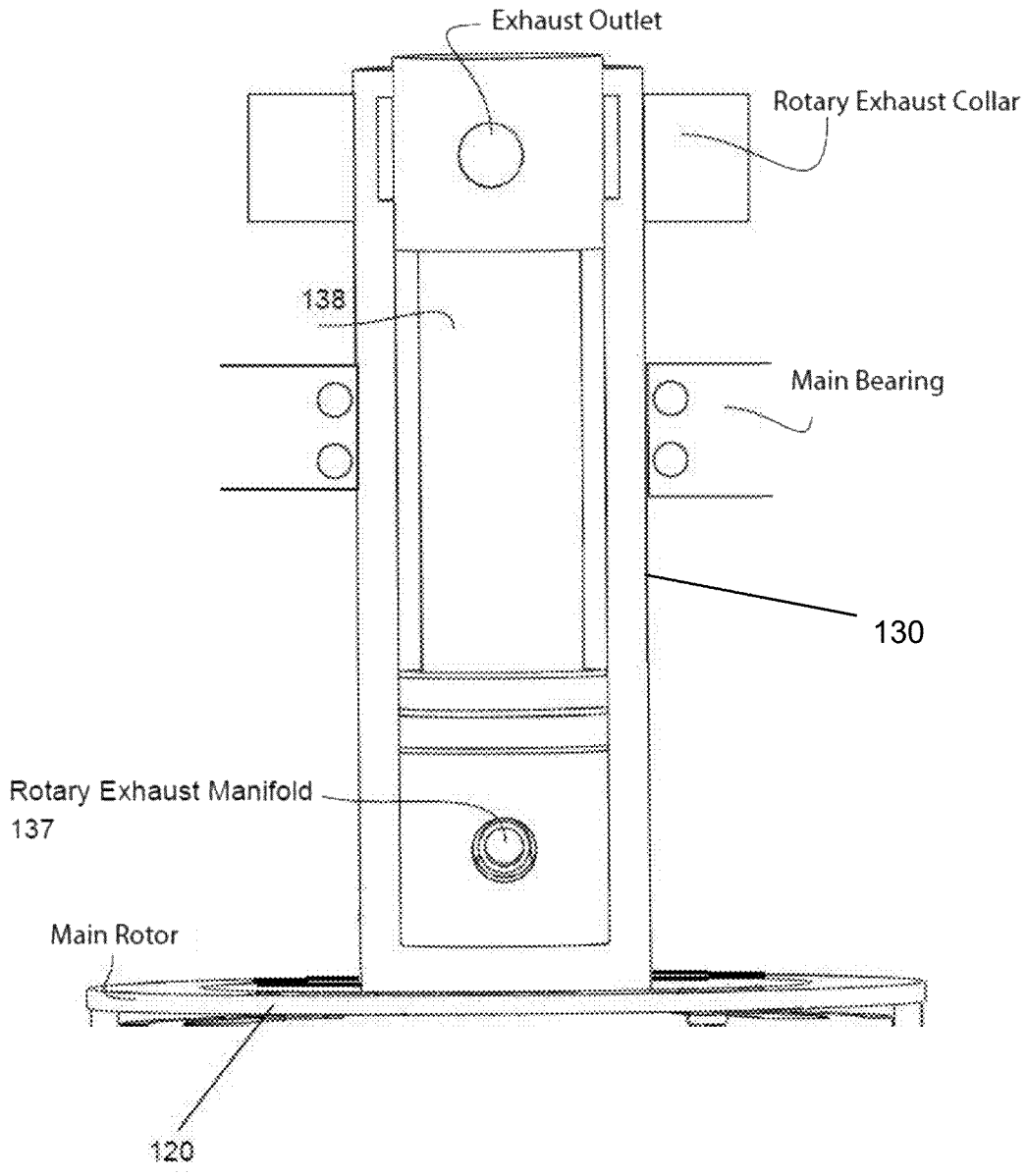
FIG. 4B is a cross-sectional view of component systems of an engine according to an embodiment of the present invention.
Figure 5:
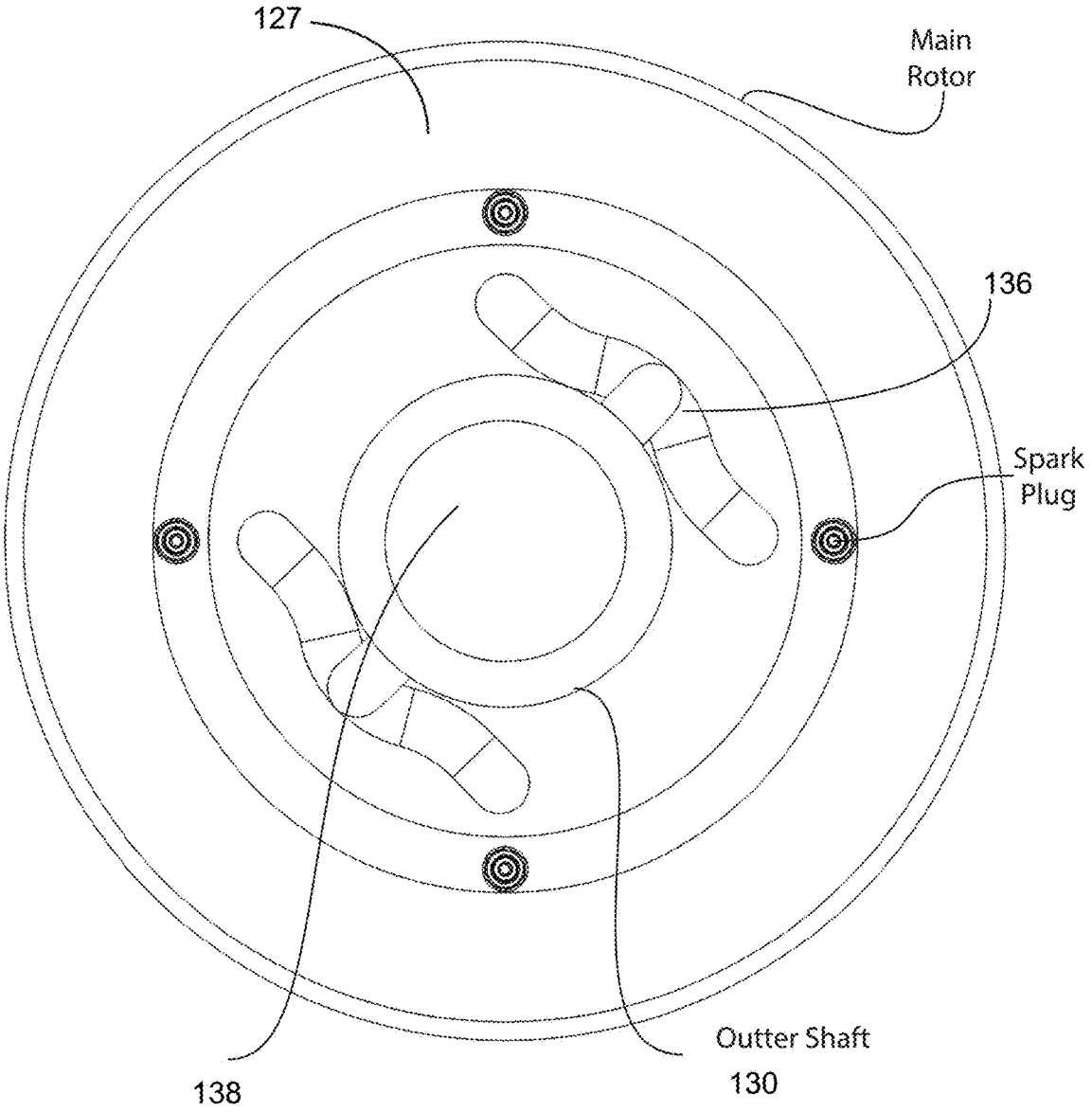
FIG. 5 is a plan view of component systems of an engine according to an embodiment of the present invention.

There are several rotating elements that are connected to the spinning cylinder rotor 120 that allow for the system to work efficiently with the rotational action of the cylinders and pistons. The cylinder rotor 120 may be in mechanical connection with a power shaft 130 that translates the rotation of the cylinder rotor 120 to a transmission system (not shown) to utilize the power generated by the engine 100. The power shaft 130 may be fixedly connected to the cylinder rotor 120 such that they rotate together at the same rotational velocity. The intake and exhaust systems as shown in FIGS. 3 and 4 may also be positioned on the cylinder rotor 120 such that they rotate with the cylinder rotor 120 as well. The cylinder rotor 120 may include both intake ports for intake of air-fuel mixture during the intake stroke and exhaust ports to expel the combustion exhaust gas during the exhaust stroke. Each cylinder may have at least one intake port and at least one exhaust port in the cylinder rotor at the top of the cylinder.

FIG. 3 shows a perspective view of the cylinder rotor 120, exhaust system intake system, and power shaft 130 in working assembly. Some structures are shown as transparent for illustrative purposes. The exhaust system may include exhaust valves 135 in fluid communication with each of the cylinders 121, which may control the passage of the exhaust gas through an exhaust port into an exhaust conduit 136 during the exhaust stroke. Each exhaust valve 135 may be operated and opened by a cam system that includes a drum 140 may turn freely with respect to the power shaft 130, but that is in mechanical connection with the rotating cylinder rotor 120, e.g., through a gearing system that times the rotation of the drum 140 such that cams thereon engage and open an exhaust valve 135 at the exhaust stroke for the corresponding cylinder 121. The cam system may include gearing with a ratio that allows it to spin at a different rotational speed than that of the cylinder rotor 120. The cam system gearing may be such that the drum 140 rotates in the same direction as the power shaft 130 at, e.g., one half the rotational speed of the cylinder rotor 120, and on a bearing. In such embodiments, four cam lobes may protrude from the drum to engage valve push rods or other engagement structures of the exhaust valves 125 of each cylinder 121. The cam lobes may be staggered along the axial dimension of the drum 140 and the exhaust valve push rods may be correspondingly staggered such that each cam lobe only engages with the exhaust valve of a particular cylinder 121, allowing the exhaust valves to remain closed during the other stages of the combustion cycle.

An exhaust conduit 136 may be connected to each of the cylinders 121 for passing the exhaust gas to an exhaust manifold 137 that delivers the exhaust gas into the exhaust collection pipe 138. The exhaust manifold 137 may be incorporated into the power shaft 130, where each of the exhaust conduits 136 routes from the exhaust valve 135 of the corresponding cylinder 121 radially inward toward the power shaft 130. The exhaust conduits 136 may connect with an exhaust manifold 137, which may be a cylindrical collar around the power shaft 130. The exhaust conduits 136 may connect with a port in the exhaust manifold 137 that is in fluid connection with the exhaust pipe 138, which rotates with the power shaft 130. The exhaust pipe 138 may be nested within the power shaft 130 and rotate therewith. The exhaust pipe 138 may deliver the exhaust to a stationary receiving pipe or plenum to which the distal end of the exhaust pipe 138 is connected via a rotary union. Because the exhaust pipe 138 rotates with the power shaft 130, rotary union or joint is required to pass the exhaust gas to a static or non-rotating structure. The exhaust pipe may include at least one distal port that allows the exhaust gas to pass into the static structure. The exhaust pipe 138 may be a ceramic material or the interior surface thereof may be lined with a ceramic material in order to prevent corrosion and accumulation of exhaust residue.

Figure 6:
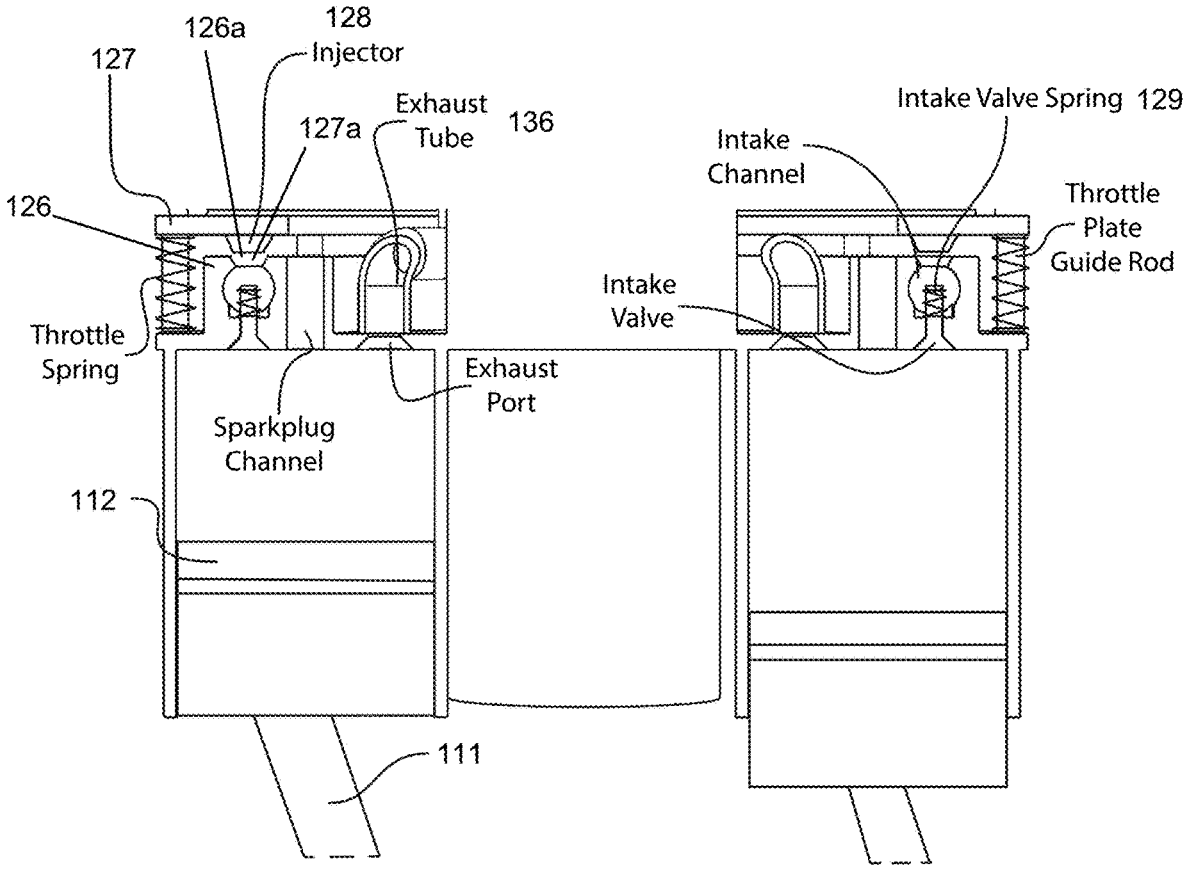
FIG. 6 is a cross-sectional view of component systems of an engine according to an embodiment of the present invention.

As shown in FIGS. 3 and 6, each cylinder 121 may include an intake port and valve 125*a* that is in fluid communication with an intake manifold 126. The intake manifold 126 may deliver fuel (e.g., an air fuel mixture) to the intake valves 125 associated with each cylinder. The intake manifold 126 may take the form of a ring chamber positioned at predetermined radius relative to the power shaft 130 and may be in alignment with the intake ports and valves 125. In some embodiments, the intake manifold 126 may include a receiving channel 126*a* along its entire length on an opposite side thereof from the cylinder rotor 120. The receiving channel 126*a* may be configured to receive a throttle ring 127 having a complementary shape to that of the receiving channel 126*a* such that the throttle ring 127 can be adjustably nested within the receiving channel 126*a*. An adjustable gap 127*a* may be present between the throttle ring 127 and the receiving channel 126*a* for allowing air to flow into the intake manifold 126 to provide the air in the air-fuel mixture. The throttle control of the engine may adjust the proximity of the throttle ring 127 in order to adjust the choke of the engine 100. The throttle ring 127 may be in static position relative to the cylinder rotor 120 with the gap 127*a* between the receiving channel 126*a* and the throttle ring 127 allowing for the rotation of the intake manifold 126, while the throttle ring 127 remains static.

The throttle ring 127 may be attached to the motor housing 101 or a frame via biased connections that bias the throttle ring 127 toward the closed position. For example, the throttle ring 127 may be connected to the motor housing or frame via studs and biasing springs (not shown) biasing the throttle ring 127 toward the closed position. The studs may include stops that prevent the throttle ring from contacting the receiving channel of the intake manifold 126, preventing full choke. The engine 100 may have a throttle control (not shown) in mechanical connection with the throttle ring 127, allowing an operator to adjust the proximity of the throttle ring 127 to the receiving channel 126*a*, and thereby adjust the choke of the engine 100.

A fuel injector 128 may be connected to the throttle ring 127 for passing fuel into the intake manifold 126. The fuel injector 128 may be positioned over the point at which the intake valve 125 is opened during the intake stroke and the intake port is exposed allowing the passage of the fuel (e.g., an air-fuel mixture) through the intake port. The fuel injector 128 may be timed to spray fuel into the intake manifold 126 as the intake valve 125 opens, allowing fuel (e.g., the air-fuel mixture) through the intake port and into the open cylinder 121. Air may be introduced into the intake system through the gap 127*a* between the throttle ring 127 and the intake manifold 126 via passages in the engine housing around the intake system.

An intake valve 125 may control the passage of the air-fuel mixture through the intake port into the corresponding cylinder 121 during the intake stroke. In some embodiments, the intake valve 125 may be operated and opened by negative pressure during the intake stroke, and the intake valve 125 may remain closed during the other stages of the combustion cycle. In some embodiments, the low pressure generated in the cylinder 121 during the intake stroke may be sufficient to open an intake valve 125 for the cylinder 121 to allow the entry of the fuel. The intake valve 125 may include a seated structure in the intake port that is held in the seated position by a biasing device, such as an intake valve spring that biases the structure to the closed position. The force applied by the intake valve spring 129 to the valve structure 125 may be overcome by the vacuum in the cylinder 121 during the intake stroke.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A rotary engine, comprising:

a. a piston rotor having a plurality of pistons thereon and positioned on a first rotational axis;

b. a cylinder rotor having a plurality of cylinders thereon and positioned on a second rotational axis;

c. a power shaft for transmitting rotational motion from one of the piston rotor and the cylinder rotor to another mechanical system, wherein the first rotational axis and the second rotational axis are at an oblique angle relative to one another, and each of said plurality of pistons is nested in one of said plurality of cylinders and the rotation of said piston rotor and said cylinder rotor is driven by combustion of a fuel in said cylinders; and d. an exhaust system comprising an exhaust manifold, wherein each of said plurality of cylinders includes an exhaust valve in fluid communication with an exhaust conduit, wherein said exhaust conduit is in fluid communication with said exhaust manifold and said exhaust manifold is mounted on said power shaft and rotates with said power shaft.

2. The rotary engine of claim 1, wherein the first and second rotational axes are positioned on a same plane and the oblique angle between the first rotational axis and the second rotational axis is in a range of about 120° to about 160°.

3. The rotary engine of claim 1, wherein said pistons each include a piston head connected to a piston rod by a movable joint.

4. The rotary engine of claim 3, wherein said piston rod is connected to said piston rotor by a movable joint.

5. The rotary engine of claim 3, wherein said piston rod is substantially orthogonal to the surface of the piston rotor.

6. The rotary engine of claim 1, wherein due to the oblique angle of the piston rotor and the cylinder rotor, synchronous rotation of the piston rotor and the cylinder rotor results in a reciprocating motion of each of the pistons within the corresponding cylinders, wherein a piston head of each of the pistons penetrates furthest into the corresponding cylinder at a proximal point in its rotational path that is nearest to the cylinder rotor and the piston is at its most retracted point in the corresponding cylinder at a distal point in its rotational path that is furthest from the cylinder rotor.

7. The rotary engine of claim 6, wherein combustion occurs at or near said proximal point.

8. The rotary engine of claim 6, wherein intake occurs at or near said distal point.

9. The rotary engine of claim 1, further comprising a fuel intake system comprising an intake manifold, wherein said intake manifold includes a hollow ring that is connected to said cylinder rotor and rotates with said cylinder rotor, wherein the hollow ring sits on a plane that is parallel to the cylinder rotor.

10. The rotary engine of claim 9, wherein said hollow ring has a substantially circular cross-section, said hollow ring is concentric with the cylinder rotor and includes fuel delivery passages that are in fluid communication with each of said plurality of cylinders in said cylinder rotor, and said hollow ring includes a channel that runs the entire length of the hollow ring on the side of the hollow ring opposite from said cylinder rotor.

11. The rotary engine of claim 10, wherein each of said plurality of cylinders includes an intake valve in fluid communication with said hollow ring, and is opened by the vacuum created by an intake stroke of a corresponding piston.

12. The rotary engine of claim 1, wherein each of said plurality of cylinders are fixed in a position orthogonally to the cylinder rotor.

13. A rotary engine, comprising:

a. a piston rotor having a plurality of pistons thereon and positioned on a first rotational axis;

b. a cylinder rotor having a plurality of cylinders thereon and positioned on a second rotational axis, and each of said plurality of cylinders is fixed in a position on the cylinder rotor such that the central axes of each of the plurality of cylinders remains parallel with the second rotational axis, wherein the first rotational axis and the second rotational axis are at a fixed oblique angle relative to one another on a same plane, and each of said plurality of pistons is nested in one of said plurality of cylinders and the rotation of said piston rotor and said cylinder rotor is driven by combustion of a fuel in said cylinders; and c. an exhaust system comprising an exhaust manifold, wherein said exhaust manifold is mounted on a power shaft and rotates with said power shaft.

14. The rotary engine of claim 13, wherein the power shaft is for transmitting rotational motion from one of the piston rotor and the cylinder rotor to another mechanical system.

15. The rotary engine of claim 13, wherein an angle between the first rotational axis and the second rotational axis is in a range of about 120° to about 160°.

16. The rotary engine of claim 13, wherein said pistons each include a piston head connected to a piston rod by a movable joint.

17. The rotary engine of claim 13, wherein due to the fixed oblique angle of the piston rotor and the cylinder rotor, synchronous rotation of the piston rotor and the cylinder rotor results in a reciprocating motion of each of the pistons within the corresponding cylinder, wherein a piston head of each of the pistons penetrates furthest into the corresponding cylinder at a proximal point in its rotational path that is nearest to the cylinder rotor and the piston is at its most retracted point in the corresponding cylinder at a distal point in its rotational path that is furthest from the cylinder rotor.

18. The rotary engine of claim 13, further comprising a fuel intake system comprising an intake manifold, wherein said intake manifold includes a hollow ring that is connected to and concentric with said cylinder rotor, rotates with said cylinder rotor, and includes fuel delivery passages that are in fluid communication with each of said plurality of cylinders in said cylinder rotor.

* * * * *